United States Patent [19]

Hodne

[11] 4,236,836

[45] Dec. 2, 1980

[54] DOT IMPACT PRINTER AND ACTUATOR THEREFOR

[75] Inventor: Ingard B. Hodne, Northbrook, Ill.

[73] Assignee: Teletype Corporation, Skokie, Ill.

[21] Appl. No.: 25,378

[22] Filed: Mar. 30, 1979

[51] Int. Cl.[3] ..... B41J 3/10

[52] U.S. Cl. ..... 400/124; 335/279; 335/274

[58] Field of Search ..... 400/124; 335/203, 279, 335/274

[56] References Cited

U.S. PATENT DOCUMENTS

| | | | |
|---|---|---|---|
| 2,423,116 | 7/1947 | Price | 335/203 |
| 2,882,368 | 4/1959 | Sauer | 335/203 |
| 3,273,093 | 9/1966 | Hayden | 335/203 |
| 3,325,755 | 6/1967 | Peek, Jr. et al. | 335/203 |
| 3,802,544 | 4/1974 | Howard et al. | 400/124 |
| 3,836,880 | 9/1974 | Matschke et al. | 400/124 |
| 3,982,622 | 9/1976 | Bellino et al. | 400/124 |
| 4,046,244 | 9/1977 | Velaquez | 101/93.34 |
| 4,072,224 | 2/1978 | Barnaby et al. | 400/124 |
| 4,077,336 | 3/1978 | Talvard et al. | 101/93.05 |
| 4,112,840 | 9/1978 | Englund | 400/124 |
| 4,117,435 | 9/1978 | Hishida et al. | 400/124 |
| 4,127,334 | 11/1978 | Watanabe | 400/124 |

FOREIGN PATENT DOCUMENTS

| | | | |
|---|---|---|---|
| 2317345 | 10/1974 | Fed. Rep. of Germany | 400/124 |
| 2440500 | 3/1976 | Fed. Rep. of Germany | 400/124 |

*Primary Examiner*—William Pieprz

*Attorney, Agent, or Firm*—A. A. Tirva; J. C. Albrecht

[57] ABSTRACT

A wire matrix printer includes a plurality of electromagnetic actuators for use as dot-matrix printer drive elements. Each actuator has a unitary bobbin body made of insulating material which includes a slot arranged to receive a flat plate armature of ferromagnetic material. The bottom of the slot is sufficiently wide to receive an edge of the plate armature and the open portion of the slot is sufficiently wide to permit the plate to pivot around the edge positioned in the bottom of the slot towards a pole of an electromagnet and then away from it to the armature's rest position. The flat plate armature includes an integral spring portion with an end which is arranged to engage a notch in the bobbin body. Positioning of the end of the spring portion in the notch flexes the spring portion sufficiently so as to provide a spring force to return the armature to its rest position, as well as, keep the armature in the slot. This arrangement allows easy, low cost assembly of bobbin and armature since no hinges, screws or external springs are necessary.

2 Claims, 24 Drawing Figures

DOT IMPACT PRINTER AND ACTUATOR THEREFOR

This invention relates to a dot impact matrix printer and to electromagnetic actuators used in high speed dot matrix printers.

BACKGROUND OF THE INVENTION

The present invention is directed to dot impact matrix printers in which the printing operation is performed by a plurality of elongated printing rods or wires each having a free end which is aligned in a vertical row in a small concentrated area adjacent the printing medium. Most commonly, the impact dot matrix-type printers produce characters by matrices of 5×7, 7×7 or 9×7 dots with additional or half step dots sometimes also being added. The dots are formed by a print head which includes a solenoid or an electromagnetic actuator which is selectively activated to drive the printing wires a very short distance to impact the printing medium. Usually only a single vertical row of seven print wire ends is carried by the print head while in some instances a double vertical row of print wires is provided. As the print head traverses the page, the actuators are selectively "fired" on a time basis so that the dots are printed, usually on-the-fly. In addition to the thirty-five positions or cross lines of a 5×7 matrix, dots are often printed between the cross lines at so-called half steps to produce a better defined character.

The present invention also relates to dot matrix printers of the page type in which a large number, e.g., forty-four to one hundred and thirty-two, of print heads extend across the page so that all or nearly all of the print heads may be actuated simultaneously to print a line of dots almost simultaneously. Then, the paper is moved in a vertical direction relative to the print wire ends to print the next line of dots. This cycle is repeated until the full matrix has been scanned and the printed line completed.

The solenoids and magnets which drive the print wires have been arranged in various fashions, such as a circular arrangement of the actuators, such as shown in U.S. Pat. Nos. 3,842,955 and 3,854,564. As disclosed in these patents, there is an attempt to concentrate the actuators for the print wires in a small, closed circle. In the more conventional and earlier developments of dot impact matrix printers, the print heads carried long, bowed wires fanning out a large array of electromagnetic actuators. The actuators require considerably more space than the small concentrated vertical row of wire tip ends. Typical of these types of curved wires are shown and disclosed in U.S. Pat. Nos. 3,690,431 and 3,882,986. In still further instances, a solenoid type construction is used with the print wire being attached to the movable solenoid core and such is shown in U.S. Pat. Nos. 3,797,629; 3,892,175; and 3,729,079.

The present invention is also directed to electromagnetic actuators of the kind, sometimes referred to as the clapper type, such as has been described in U.S. Pat. No. 3,828,508. In this patent, a circular arrangement of clapper types of actuators is disclosed as an attempt to simplify the construction for the printing head. A still further disclosure of a print head actuator of a simplified construction, but using a torsion spring actuator, is disclosed in U.S. Pat. No. 3,982,622.

The problems due to friction when using long bowed print wires, as well as the inertia for moving the long print wires and their actuators, are well known. Likewise, the mass and the size of the print heads result in inertia problems and the use of many parts therein raises the cost of the printing head.

Thus, there is a need for a lightweight, compact and inexpensive print head which is easy to assemble and which uses substantially straight print wires. In this invention, the wire actuators are assembled of elements which perform multiple functions and which can be readily assembled without the use of the typical pin hinges, separate springs and other adjustment elements, thereby resulting in a new and improved actuator having general utility for various types of dot matrix printers.

SUMMARY OF THE INVENTION

Accordingly, a principal and general object of the invention is to provide a new and improved construction for a dot matrix printer.

Another and more specific object of the invention is to provide a dot matrix printer having a substantially straight wire with the electromagnetic actuators being aligned in a very small compact space with their electromagnets having a plate-like armature which drives the print wires.

Another object of the invention is to provide a new and improved electromagnetic print wire actuator.

These and other objects of the invention will become apparent from the following detailed description taken in connection with the accompanying drawings in which.

Figure 1:
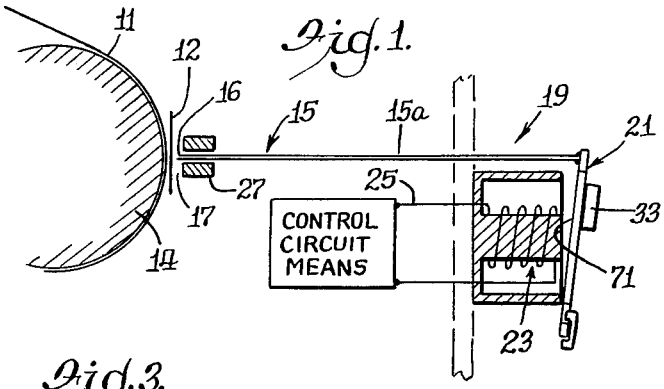
FIG. 1 is a diagrammatic view of a dot matrix printer having an actuator for a single print wire constructed in accordance with and embodying the principals of the present invention.
Figure 2:
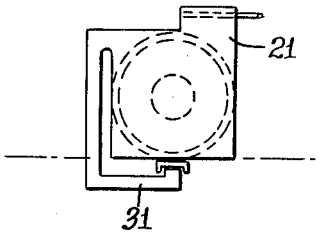
FIG. 2 is an end view of the actuator shown in FIG. 1.

As shown in the drawings for purposes of illustration, the present invention is embodied in a wire matrix printer having a printing medium 11, such as a sheet of paper, and having an inked ribbon 12 backed by a suitable support, such as a conventional, rotatable platen 14 which may be turned to line space the paper in a conventional manner. To form the dots on the paper to form the characters, each print wire 15 is actuated to bring its small, free end 16 against the ribbon with sufficient force to impact the paper to leave a dot thereon. The print wire is driven by an actuator 19 of the electromagnetic kind having an armature or a clapper 21 which is mounted for fore and aft movement in response to energization of a coil 23 which is connected by suitable lead wires 25 to the controlling electrical circuit means 26. The forward end 16 of the print wire may be guided by a suitable print wire guide means 27.

Heretofore, the electromagnetic actuators have been relatively complex in that they are formed with many parts and require time consuming assembly operations, such as, for example, shown in U.S. Pat. No. 3,842,955 wherein a separate spring biases the clapper or plate actuator to the return position and there is provided a separate mounting assembly which is mounted by suitable fasteners to the bottom of an assembly which also holds the solenoid core. In this patented device, the solenoid core, in turn, is mounted by a threaded fastener to a supporting frame. In still other constructions, additional fasteners and other pivot pins and hinges are used. Each of these particular pieces takes space at a location where space is not available if one is to use straight print wires and adds additional mass which must be shifted in a movable print head kind of printer. Further, each of the additional pieces is a cost item and its assembly further necessitates increased labor costs for the entire print head.

Figure 7:
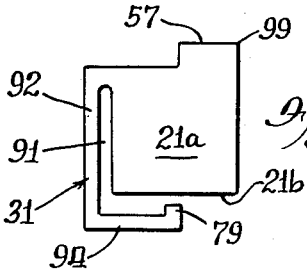
FIG. 7 is a side elevational view of a plate armature having an integral return spring and constructed in accordance with a preferred embodiment of the invention.

In accordance with the present invention, the electromagnetic actuator 19 may be formed with a small, light weight configuration having relatively few parts because many of the parts provide multiple functions and are designed to provide good magnetic actuating efficiency. To achieve the foregoing, the armature 21, as best seen in FIG. 7, is made as a one-piece stamping from a flat plate of ferromagnetic material with an integral return spring portion 31, which will be flexed from the remaining flat, central armature portion **21*a* so as to provide the return spring bias to return the armature 21 against the back stop means 33, as shown in FIG. 1. As will be described in greater detail hereinafter, the preferred stop means 33 is a portion of an insulating bobbin means 35 on which is wound a coil 39** of wire.

As will be explained in greater detail hereinafter, the bobbin means 35 has the coil 39 of fine wire wound thereabout with the ends of the coil forming lead lines 25 extending to metal connecting leads or pins 41 projecting outwardly from an end wall 43 of the bobbin means 35.

Figure 5:
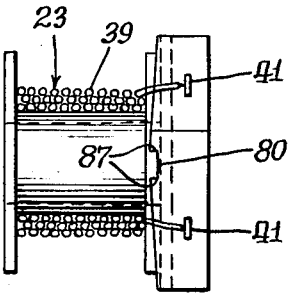
FIG. 5 is a view showing the coil on the bobbin assembly for the preferred electromagnetic actuator.
Figure 6:
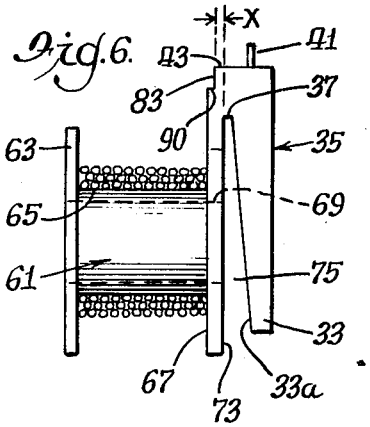
FIG. 6 is a side elevational view of the bobbin assembly shown in FIG. 5.

The plate armature 21 is preferably assembled with and pivotally mounted on the bobbin means 35 merely by a sliding operation involving a sliding of a pivot edge **21*b* into a U-shaped gap 75 with the pivot edge 21*b* sliding along pivot surface 37 at the bottom of the gap. During this sliding operation, a tag shaped end 79 of the integral spring 31 slides along outer surface 85 of the bobbin at a location exterior of the gap until the tag end 79 snaps into a notch 80 (FIG. 5) in the bobbin leaving the tag end 79 displaced and flexed by a distance "X" (as illustrated in FIG. 6) from the pivot end 21*b***. Because the predetermined distance "X" may be accurately controlled in the molding of the plastic bobbin, the deflection of the spring tag end and the spring tension may be closely controlled without complicated adjustment screws or the like. Of course, adjustment screws or the like could be added if so desired.

Figure 3:
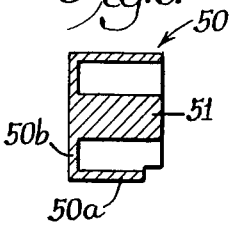
FIG. 3 is a sectional view of a core and shell used in the preferred construction for the electromagnet shown in FIG. 1.
Figure 4:
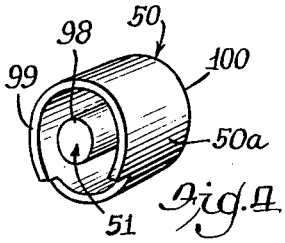
FIG. 4 is a perspective view of the core and shell shown in FIG. 3.

The preferred subassembly of the armature 21 and bobbin means 35 with the wire coil 39 thereon are then mated with a one-piece, ferromagnetic core and shell means 50, as best seen in FIGS. 3 and 4, preferably made as a low cost screw machine part from ferromagnetic bar stock. As will be explained in greater detail, the central core 51 and surrounding cylindrical shell **50*a* provide a small highly efficient flux path for use with a large area central armature portion 21*a* on the armature. The core and shell means 50 may be machined from a rod of magnetic iron or a low carbon steel although the core and shell means 50** could be cast by a powder metal process to provide a low-cost part.

Figure 8:
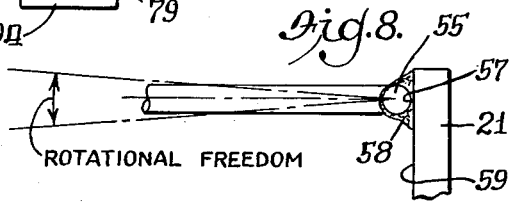
FIG. 8 is a diagrammatic view of the preferred manner of connecting the print wire to the plate armature.

As will be described in greater detail hereinafter, the preferred construction of print heads using these magnetic actuators has print wires 15 each with a substantially straight portion **15*a* from its free end 16 to its connecting end 55 which herein is a bent end or portion 55 extending transversely, preferably at a right angle, and which is connected in a suitable manner to an end 57 of the armature at a point located on the print wire axis. Herein, a low-cost and preferred manner of connection is achieved by use of an elastomeric adhesive 58 surrounding the bent end 55 thereby providing a metal to metal contact between the inner facing surface 56 on the bent end 55 and the facing surface 59 on the armature 21, as best seen in FIG. 8. This connection also allows some rotational freedom of the armature as diagrammatically illustrated in FIG. 8 since the armature 21 rotates about a pivot axis in an arcuate motion whereas the print wire portion 15*a*** is provided a straight line rectilinear motion.

Additionally, as will be explained hereinafter, the actuators 19 may be readily combined to provide printing in a 7 level matrix, an 8 level matrix, or other matrix configurations for a movable print head; or they may be mounted at stationary locations in a line matrix dot printer. In a line printer, a shuttle means may shift the print wire ends 16 laterally for one space because of the flexible connections between the print wires and their respective armatures. Further, the actuators may be arranged to provide a double row of side-by-side 7 level print wires 15 so that twice the speed of a conventional 7 level print head may be achieved.

Referring now in greater and more specific detail to the individual elements forming the actuator 19 for a single print wire, the plastic bobbin means 35 is a one-piece structure having a spool shaped body 61, as best seen in FIG. 6, with an outer generally annular flange 63 surrounding a hollow, centrally cylindrical hub 65 into which is projected the solid metallic core 51, as will be explained in greater detail hereinafter. At the other side of the plastic body is another flange-like member 67 which is spaced opposite and generally parallel to the outer flange 63. The flange-like member 67 has a central aperture 69 so that the post 51 may project into the aperture 69 to be closely adjacent the armature portion 21*a* of the plate armature 21, as best seen in FIG. 1. The other side of the flange element 67 is a generally vertical surface 73 which acts as a forward limit stop for the forward amount of movement of the armature 21 and likewise determines the forward limit of the print wire 15 toward the printing medium. Because the parts may be precision molded, there is no need for conventional adjustable front or rear stops although such may be provided and still fall within the purview of the present invention.

As above described, the assembly of the armature 21 in-bobbin means 35 results in a pivotal mounting of the armature 21 within the slot 75 between the front stop surface 73 and the rearward stop surface 33*a*. The pivoting surface 37 on the bobbin at the end of the U-shaped slot 75 provides a predetermined locating surface for locating the armature in a vertical direction relative to the central core or post 51, as well as the coils 39 of the electromagnetic coil 23. With the armature seated in the slot, the pivot edge 21*b* of the armature sits on the pivot surface 37. Herein, the bobbin is molded of a suitable plastic material, such as nylon. It is possible to mold such bobbins so that the particular surfaces are located relative to one another so as to provide the desired spring tension and dimensional accuracy caused by the deflection of the spring arm 31 on the plate armature 21 as will now be described in greater detail.

Herein, the tag or free end 79 on the flexed spring arm portion 31 is seated in the receiving seat or notch 80 in the bobbin flange or hub wall 67 at a location adjacent but spaced laterally from the vertical surface 73, at the distance "X", as shown in FIG. 6, which determines the amount of deflection of the spring arm and thereby the spring tension for returning the armature plate against the stop surface 33*a*. When the tag end 79 is seated in the notch 80, it is in a sense anchored and holds the armature pivot edge 21*b* against the bobbin pivot surface 37 and holds the same against sliding downwardly therefrom when the armature is hanging downwardly in the slot 75. As previously explained, the flat plate armature 21 may be readily assembled by sliding the armature portion 21*a* laterally into the opening 75 with the free tag end 79 sliding along an outer side wall 85 of the flange wall 67 until tag end 79 snaps into the seat notch 80 which has opposite shoulder walls 87 holding the tag end 79 against lateral movement within the notch 80. The rear wall 83 of the notch actually determines the amount of spring deflection when the pivot edge 21*b* is seated on the surface 37. It will be appreciated that the lower shoulder wall 90, as best seen in FIG. 6, for the notch prevents a downward movement of the tag end 79 from the seat or the downward sliding of the plate armature from the opening 75. Thus, in a simple manner without use of any screws or other adjustments, the plate armature may be readily positioned with a proper spring force merely by sliding and snapping the tag end 79 into the notch 80.

Turning now in greater detail to the preferred plate armature 21, the preferred plate armature is a simple stamping produced from flat strip stock of ferromagnetic material. The thickness of the armature plate is determined by several factors including the cross section needed to pass the magnetic flux and the desire to keep the mass of the armature low. Other factors in determining the size and thickness of the armature are that of providing sufficient return spring force without such a working stress that the spring would be easily damaged. The preferred ferromagnetic material represents a compromise between that needed for a high permeability in the armature and the good return spring properties for the integral flexed arm 31. One such material is AISI 1050 cold rolled carbon steel with no heat treatment; and another alternative is a low carbon steel with suitable selective case hardening of the spring arm 31 only. By way of example only, the flat strip material may be about 0.75 millimeters thick and about 22 millimeters square.

The preferred integral spring arm 31 is generally L-shaped with a first long arm 92 separated by a slot 91 from and joining at one end the central armature portion 21*a*, as best seen in FIG. 7. The slot 91 is also generally L-shaped with a bottom horizontal slot portion, as seen in FIG. 7, separating a right angle arm 94, the end of which carries the upwardly formed small tag end 79 which fits in the notch 80 as above described. Manifestly, the shape and the particular configuration of the integral spring arm may be changed from that shown in the preferred embodiment of the invention. Depending on the type of construction used and the position of the notch relative to the armature portion 21*a*, the spring arm may in fact have another leg so that the arm extends even further, as shown in FIG. 7. Preferably, the anchor or tag end 79 is located close to and centrally of the pivot edge 21*b* to provide a small return spring force as that is all that is needed. Also, it will be apparent that the particular configuration for the integral spring may be changed depending upon the orientation and the use of the particular matrix in one of the print heads which will be described hereinafter. That is, armatures 21 may be turned around so that their connecting portions 57 may be either on the left or the right side of the vertical row of wires depending on which side of the connecting portion the bent wire end 55 is fastened.

Figure 8A:
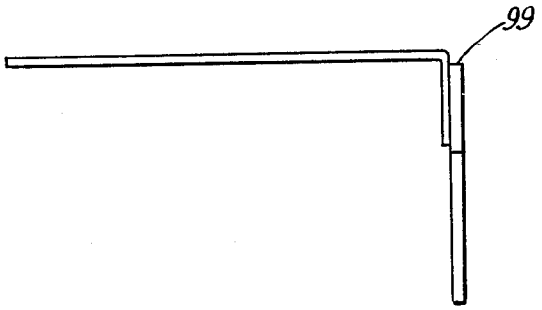
FIG. 8A is a fragmentary plan view showing a print wire connection to an armature.

The print wires 15 may be formed of conventional material used for print wires which is usually straight music wire ranging above 0.011 inch in diameter with the preferred print wires 15 having a diameter of 0.013 to 0.014 inch. The length of the straight portion 15*a* varies considerably depending upon the position of the print wire and its associated electromagnetic actuator 19, as can be readily understood from FIGS. 9 and 10, wherein the actuators in the right-hand pair have wires which are considerably longer in length than the left-most actuator. By way of example, a typical print wire would have a length of approximately 50 millimeters with a bent end portion 55 of approximately 14 millimeters. The preferred construction provides a relatively good metal to metal surface contact between the bent end 55 (FIG. 8) of the print wire and the armature connecting end 57 with the bend being located just outwardly of the outermost corner 99 of the armature end 57, as best seen in FIG. 8A. This relatively long length for the bent end portion 55 allows sufficient area for adhesion by the adhesive material 58 while having good energy transfer between the metal to metal facing surfaces on the wire and the armature 21.

Figure 18:
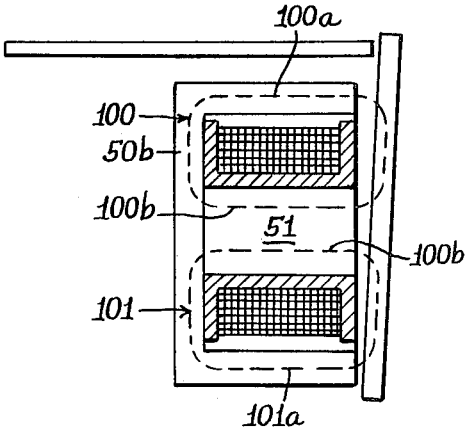
FIG. 18 is an illustration of the electromagnetic configuration for the plate-like armatures used to drive the print wire and constructed in accordance with the preferred embodiment of the invention.

The configuration of the electromagnetic provides a concentrated flux path which provides increased efficiency within a small space and allows the use of a wide but thin large area armature plate portion 21*a*. More specifically, the pole face of the magnet is constituted by circular end 98 of the core 51 and substantially annular surface 99 of the shell 50*a*, which are in the same vertical plane. Referring to FIG. 18, if the core end 98 is considered the north pole of the magnet, then the annular surface 99 becomes the south pole of the magnet. The flux lines 100*b* and 101*b* leave the north pole end 98 and flow into the center of the armature plate portion 21*a* and then spread radially outwardly in all directions to re-enter the shell at the south pole annular surface 99. The magnetic circuit is completed by the flux flowing through the shell 50*a* as indicated at 100*a* and 101*a* and back through the metal end wall 100 which is integral with the core 51. The flux lines are conducted through a sufficient volume of metal in the armature plate because it is a wide plate having a considerable surface area and only a thin width dimension is needed to provide the necessary volume to conduct the flux lines. Most of the flux paths are substantially in metal. The working air gap is between the armature portion 21*a* and the end 98 of the core 51 with the air gap between the shell annular surface 99 and the armature portion 21*a* being in the magnetic return circuit. High efficiency is achieved because the flux across both of these airgaps will act on the armature portion 21*a* in the same direction, and cause the armature portion 21*a* to accelerate. High efficiency is also due to the iron shell 50*a* which encloses the coil. The shell thus will act as a conductor for the return circuit, reducing stray flux and making available a maximum amount of flux to do useful work.

In comparison, the widely used plunger-type solenoid has in the magnetic return circuit an airgap which is perpendicular to the plunger motion. Flux acting across this airgap will therefore do no useful work on the plunger. The conventional clapper type magnet, also widely used, has an open frame structure and exposed coil. This makes the return path for the magnetic circuit ill defined, with consequent stray flux and loss of efficiency.

Figure 19:
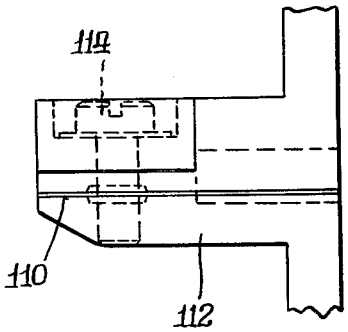
FIG. 19 is a plan view of a print wire guide means.

Preferably, the wires are not guided except at the front guide means 27 which is located closely adjacent the ribbon 12. The front guide means 27 may take various shapes and forms but is herein shown in FIGS. 19 and 20 as comprising a series of apertures 110 through a block shaped body 111 which is formed with a main section 112 to which is secured a removable section 113, the sections 112 and 113 being held together by a suitable threaded fastener 114. In this construction, each of the guiding cylindrical slots 110 is formed by generally a semicircular groove formed in a pair of opposed faces 115 and 116 in the respective block sections 112 and 113. The guide slots 110 are parallel to each other. The block body 111 has a T-shaped portion 117, as shown in FIG. 19, for mounting on the print head frame (not shown).

Figure 20:
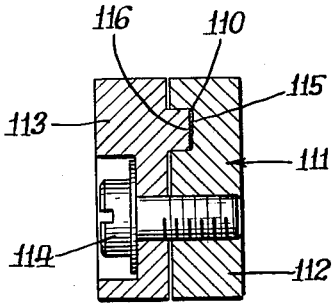
FIG. 20 is an end view of the print wire guide means of FIG. 19.
Figure 21:
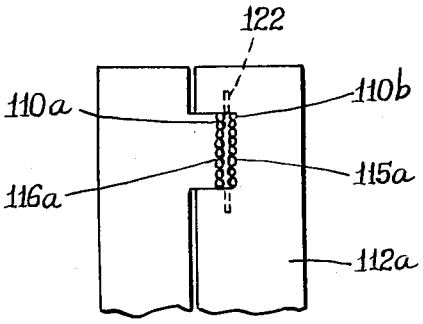
FIG. 21 is an end view of a print wire guide means for a double row of print wires.

For a double row print head having 14 print wires, it is preferred to use generally the same configuration as shown in FIG. 21 except that a central floating plate guide 122 may be provided with pairs of opposite semicircular grooves therein providing one-half of the guide grooves 110*a* and 110*b*, the other half of the grooves being formed in the faces 115*a* and 116*a* which are similar to the faces 116 and 115, as described with reference to FIGS. 19 and 20. The thin, floating center guide is merely mounted within the main block body 112*a*. The preferred wire guide means 27 is made of some plastic material molded, such as delrin with teflon fibers, to provide a low-cost, long life guiding with relatively little friction. Also, because of the low force loading on the generally straight wires 15, there is no need for the expensive jewel-type guides used in some prior art dot impact printers. The reducing of the friction and the loading also reduces the power requirements for the actuation of the wires thereby allowing the use of the relatively small compact electromagnetic actuators, as above described.

Figure 9:
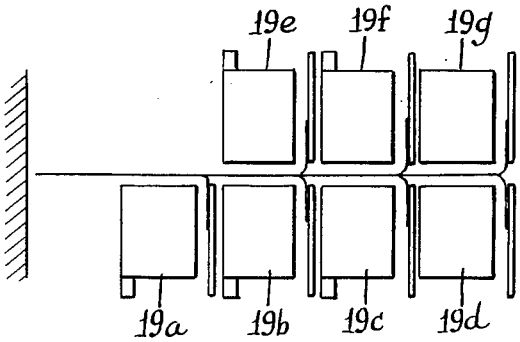
FIG. 9 is a plan view of a seven level print head constructed in accordance with the preferred embodiment of the invention.

The print head construction, of course, may have varius numbers of actuators 19 and the typical and most common construction is a 7 level print head, such as shown in FIG. 9, which comprises seven electromagnetic actuators 19*a*, 19*b*, 19*c*, 19*d*, 19*e*, 19*f* and 19*g*. The actuators 19*a*, 19*b*, 19*c* and 19*d* are substantially aligned in one row on one side of a vertical plane through the print wires with the axes of their respective cores 51 being coaxially aligned. On the other side of the vertical plane, through the seven print wires, are three electromagnetic actuators 19*e*, 19*f* and 19*g* with their respective axes substantially coaxial. Herein, the shortest print wire is the uppermost of the seven print wires. Then, the print wires 15*b* and 15*e* are the next shortest and one of them is second uppermost and the other is third uppermost. The print wires 15*c* and 15*f* are longer than the wires 15*b* and 15*e* and are the 4th and 5th wires down. The print wires 15*d* and 15*g* are the longest and provide the lower two-level dots.

Figure 10:
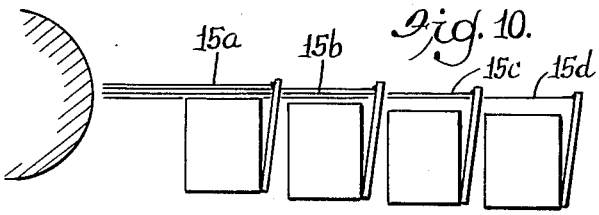
FIG. 10 is a side elevational view of the print head shown in FIG. 9.
Figure 11:
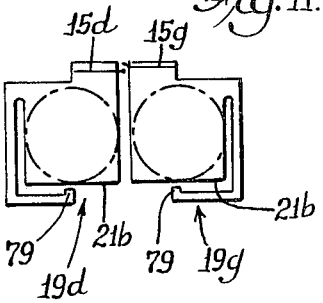
FIG. 11 is an end view of the print head shown in FIGS. 9 and 10.

In the seven level print head configuration shown in FIGS. 9, 10 and 11, each of the pivot surfaces 21*b* for the armatures 21 is located upwardly slightly above the tag ends 79, as can best be visualized from the illustration of FIG. 11.

Figure 12:
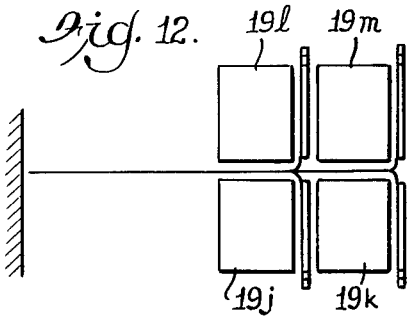
FIG. 12 is a plan view of an 8 level print head and constructed in accordance with the preferred embodiment of the invention.
Figure 13:
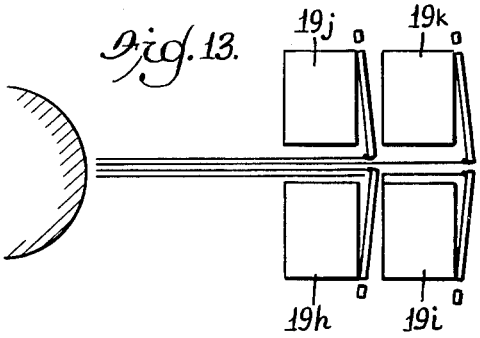
FIG. 13 is a side view of the print head shown in FIG. 12.
Figure 14:
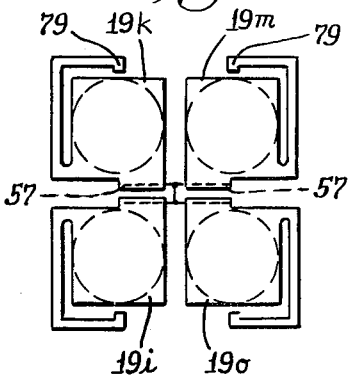
FIG. 14 is an end view of the print head shown in FIGS. 12 and 13.
Figure 15:
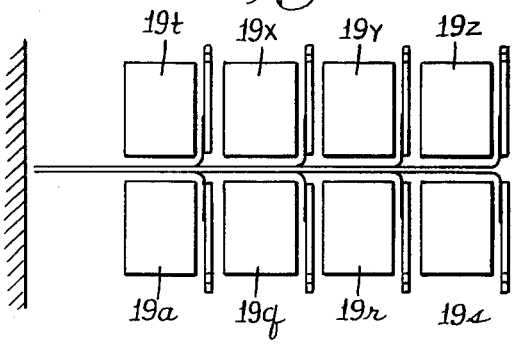
FIG. 15 is a plan view of a 7 level double row print head.

On the other hand, the electromagnetic actuators 19 may be inverted and located above a lower pair of actuators, such as shown in FIG. 13. That is, the actuators may be inverted so that their pivot surfaces 21*b* are located above the print wires with their respective print wires fastened to the lower ends of the armatures 21, as can best be seen in FIGS. 13 and 14. The print head illustrated diagrammatically in FIGS. 12 and 13 is an eight level head having eight print wires. As can best be understood from FIGS. 12, 13 and 14, there are four print wires 15 actuated by four upper level actuators 19*j*, 19*k*, 19*l* and 19*m*, and beneath them are four print wires 15 actuated by four lower level actuators 19*h*, 19*i*, 19*n* (not shown) and 19*o*, which is best seen in FIG. 14. All four of the upper level electromagnetic actuators 19 have their armatures 21 inverted with the actuating ends 57 being disposed downwardly, as best seen in FIG. 14, and with the offset tag end 79 being located above their pivot edges 21*b*. Thus, it will be seen from FIG. 14 that four actuators 19 can be concentrated within the relatively small space with the axes of the actuator cores and the axes of the print wires being substantially parallel and straight. The 8 level print head provides the capability of generating descenders for lower case characters, such as g, j, y, et cetera.

In the 8 level print head, the print wires 15*j* and 15*l* from the upper two actuators 19 may make the upper two impressions with the pair of actuators therebeneath making the third and fourth level impressions. Then, the print wires of actuators 19*k* and 19*m* may make the fifth and sixth impressions with the actuators 19*i* and 19*o* making the seventh and eighth impressions.

Figure 16:
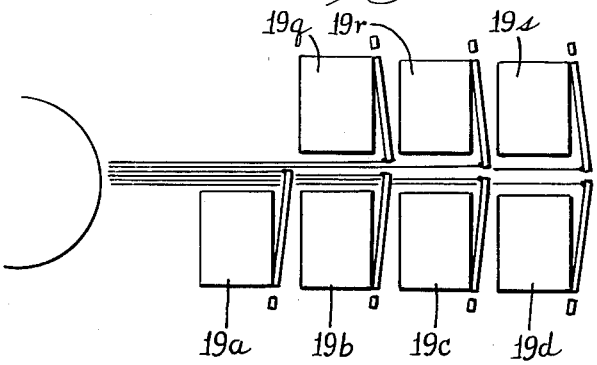
FIG. 16 illustrates a side elevational view of the double row print head shown in FIG. 15.
Figure 17:
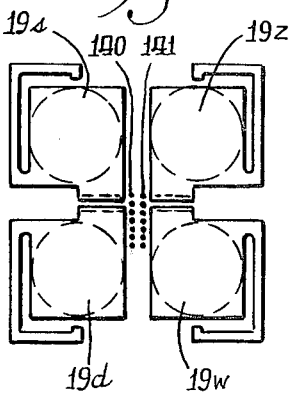
FIG. 17 is an end view of the print head shown in FIGS. 15 and 16.

To double the speed of printing of a 7 level matrix printer, a double row print head may be constructed with seven print wires in each of the two vertical rows 140 and 141 as shown in FIG. 17. As shown in FIG. 16, the row 140 may have print wires from four bottom actuators 19*a*, 19*b*, 19*c* and 19*d* and from three superimposed actuators 19*q*, 19*r*, and 19*s*. The second row 141 of seven print wires may include four bottom actuators 29*t*, - - - - 19*w*, and from three superimposed actuators 19*x*, 19*y* and 19*z*. Thus, without increasing the operating speed of the actuators, the print speed may be twice that of a conventional print head. This is of particular importance where the speed is of an upmost importance for some operations.

Figure 22:
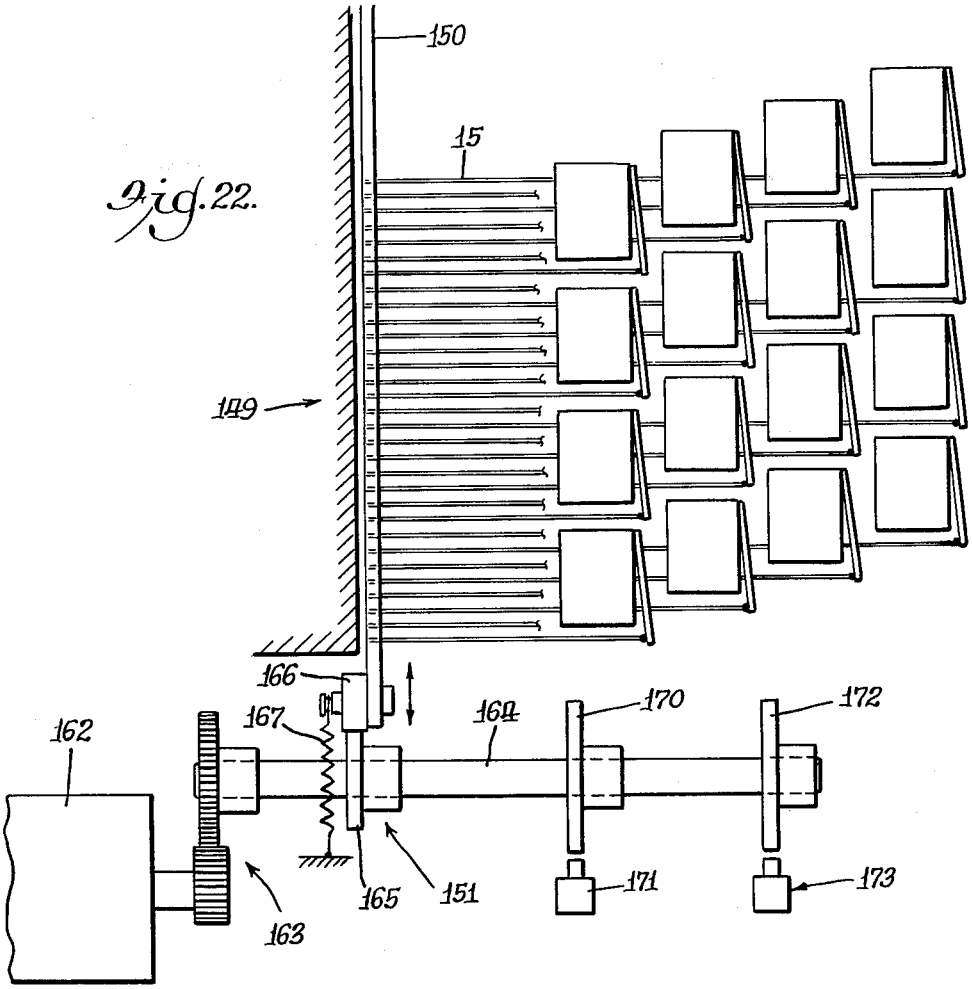
FIG. 22 is a plan view of a line printer using the preferred electromagnetic print wire actuators and constructed in accordance with the invention.
Figure 23:
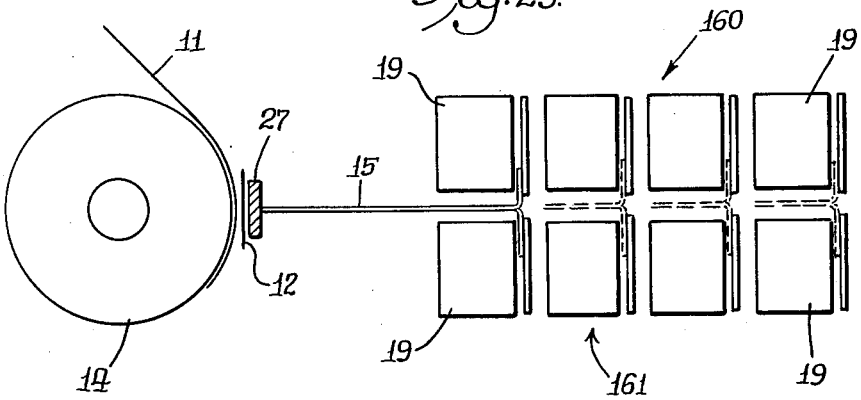
FIG. 23 is a side elevational view of the line printer of FIG. 22.

A line printer 149 constructed in accordance with the present invention, as best seen in FIGS. 22 and 23, is provided with an oscillating shuttle member 150 which is connected to the wire guide means 27 at the wire tip ends 16 so that as the shuttle is reciprocated in a linear direction by a motor driven actuating means 151, each of the print head tips 16 may cover one or two character widths. The flexible connection of wire 15 to the armature 21 will allow such deflection.

The line printer 149 has one print wire with associated actuator 19 for each character column. The spacing between print wires is typically 0.100 inch. The physical dimensions of the actuators 19 determine the spacing between the actuators in each row across the machine which, in this instance, is 0.800 inch. To obtain one print wire at every 0.100 inch, it is therefore necessary to have 8 rows of actuators 19. In FIG. 23, the 8 rows are arranged with four rows of actuators 19 below the print wires and four rows above. The tips 16 of the wires 15 are supported and guided by the oscillating guide shuttle 150 which has an excursion that spans the width of one character.

In this line printer 149, the paper will be indexed seven times with the print wires being selectively actuated in each of the respective levels. For example, when doing the upper, first level for a character, all of the characters having dots to be made in the upper left-hand corner of the matrix will have their respective actuators fired to simultaneously print dots in the left-most upper level. As the shuttle 150 moves to the right to the next upper level position in the matrix each actuator will be selectively fired where it is desired to have a dot in this second position in the top level of the matrix. The shuttle 150 then continues to move to the right to allow dots to be printed in each of the third, fourth, and fifth upper level positions in a five x seven matrix. The paper is now indexed so that the ends of the print wires are now aligned in the second vertical level of the seven level matrix. As the shuttle 150 moves back toward the left, the actuators 19 are selectively fired at those character matrices having a dot in any one of five positions horizontally across the second level. The paper is again indexed to bring the tips in line with the third level of the matrix and the tips are swept by the shuttle 150 laterally across each of the five positions in the third level. This action is repeated until all seven levels have been swept.

The time it would take to print one line of text would be about 125 msec., or 8 lines per second, or 480 lines/-min.

A large category of printers where this line printing arrangement would be very useful is in the field of small printers, for example, from 20 to 40 columns. A speed of 200 lines/min. or less would be adequate for such printers. Taking advantage of the lower speed, the oscillating excursion of each print wire could be increased to span two characters instead of one previously, and the number of actuators 19 can therefore be reduced by one-half. This arrangement would provide a very simple and low cost machine.

Another application of this line printer arrangement is for printer/plotter machines. Because dots can be printed anywhere on the page, it makes it possible to generate graphs, charts and drawings. Character size and styles are virtually unlimited.

The printer illustrated in FIGS. 22 and 23 includes a motor drive means 162 having a gear drive 163 for driving a timing shaft 164 on which is mounted a cam 165 for oscillating a cam follower 166 which is resiliently biased by a spring means 167 to follow the cam 165 and thereby shift the shuttle 150 for the print wires 15. To provide the proper timing, depending upon the position of the shuttle, there is a timing disc 170 which operates a timing pulse generator 171 for generating a timing pulse for the printing operation. Another timing disc 172 may be used in connection with a pulse generator 173 to generate a signal signifying that a line has been printed and that it is time for the paperfeed to advance the paper relative to the print heads to print the next line.

Although the actuator 19 has been described in connection with a dot matrix printer, its high efficiency and low cost make it suitable for other uses. While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. In a dot matrix printer for printing a line of dots, the combination comprising:

a plurality of straight print wires aligned in a substantially horizontal line and spaced from each other in a horizontal direction and each having a print end, the other end having a bent portion a laterally movable guide means for shifting laterally said print ends within at least one matrix, a plurality of stationary electromagnetic actuators for said print wires arranged in upper and lower rows, a plate armature on each of said actuators having an operative connecting portion fastened to another end of the print wire to shift its associated straight print wire to a printing position, a flexible connecting means joining each of said bent portion of said print wires to its actuating armature and allowing shifting of its associated print end across the entire matrix by said guide means, by permitting rotational freedom for said print wires about said respective bent portions and an integral return spring portion on each of said armatures to provide a return spring force to return said print wires from said print medium, means to shift said print ends in first one direction across at least a portion of one matrix and then to return said print ends in the opposite direction while selected ones of said actuators are actuated to print dots in said horizontal line, and means carrying the paper vertically to position said print ends opposite another level in said matrices for printing second level dots in said matrices.

2. In a wire matrix printer having a plurality of print wires, each of said print wires having a print end for engagement with a recording medium and having another connecting portion, an electromagnetic actuator for each of said wires comprising a bobbin having a unitary body of insulating material, the bobbin having a hub with bore therein, a first flange located on one end of the hub and a second flange located at the other end, the second flange having a U-shaped slot therein, the slot having a forward and a back surface and an opening which is substantially wider than the bottom of the slot, the bore extending through the first flange and through a portion of the second flange into an opening defined by the slot, a flat plate armature of ferromagnetic material pivotally positioned in the U-shaped slot so that one edge around which the armature pivots is located in the bottom of the slot, and a portion of the armature sufficiently large to attach the connecting end of the wire protrudes from the slot, the connecting end of each print wire comprising a substantially right angle bend at the end of the wire, the bent end butted against the plate armature and fastened to the armature by an adhesive means which provides a resilient connection between the armature and the print wire permitting rotational freedom for the print wire about said bent end, an integral return spring portion engaging a notch located on an outside surface of the second flange being flexed thereby urging the plate armature against the back surface of the slot and keeping the edge of the armature positioned in the bottom of the U-shaped slot, an electrical coil wound around the hub, a unitary cylindrical metallic shell surrounding the coil and spaced therefrom, the shell having an end constituting a first pole face, an integral central metallic core extending from the other end of the shell through the bore into the opening defined by the slot, the core having an end face constituting a second pole face, both pole faces located in substantially the same plane, and an electrical control circuit means for providing an electric current to the coil and establishing a magnetic field for attaching the plate armature to the pole faces against the urging of the integral spring portion of the armature and thus driving the associated print wire against the record medium.

* * * * *